US006058834A

United States Patent [19]

Beckwith

[11] Patent Number: 6,058,834

[45] Date of Patent: May 9, 2000

[54] TRANSFER PRESS APPARATUS

[75] Inventor: George S. Beckwith, Frontenac, Kans.

[73] Assignee: Hix Corporation, Pittsburg, Kans.

[21] Appl. No.: 09/240,172

[22] Filed: Jan. 29, 1999

[51] Int. Cl.[7] ..... B30B 1/04; B30B 15/34

[52] U.S. Cl. ..... 100/99; 100/233; 100/257; 100/282; 100/293; 100/320; 156/583.9

[58] Field of Search ..... 100/99, 233, 257, 100/266, 283, 293, 292, 319, 320; 156/583.8, 583.9

[56] References Cited

U.S. PATENT DOCUMENTS

| | | | |
|---|---|---|---|
| 15,011 | 6/1856 | Knauer | 100/292 |
| 1,100,592 | 6/1914 | Madden | 100/99 |
| 3,988,981 | 11/1976 | McDonald | 100/292 |
| 5,252,171 | 10/1993 | Anderson et al. | 156/583.9 |
| 5,435,883 | 7/1995 | Myers | 156/583.9 |

*Primary Examiner*—Peter Vo
*Assistant Examiner*—Louis K. Huynh
*Attorney, Agent, or Firm*—Shook, Hardy & Bacon LLP

[57] ABSTRACT

A press is provided for applying heat transfers to rigid or flexible substrates such as plaques, tiles, plates, clothing and the like. The press includes a frame (10) presenting a lower platen (12), and an upper platen (58) supported on an arm (50) for movement toward and away from the lower platen. The upper platen (58) presents a mounting bracket (78) by which it is connected to the support arm, and a pressure adjustment assembly (54) is supported between the upper platen and the support arm for adjusting the position of the upper platen. The pressure adjustment assembly (54) includes a pin (80) supported in apertures of the support arm (50) and the upper platen (58) and a lever (88) protruding generally radially from the pin for permitting the rotational position of the pin to be adjusted. The pin (80) is eccentric, including at least one first region defining a first longitudinal axis and at least one second region defining a second longitudinal axis that is parallel to and offset from the first longitudinal axis. The different regions of the pin (80) are supported in different ones of the apertures such that rotation of the pin in the apertures adjusts the position of the upper platen (58) relative to the support arm (50).

9 Claims, 4 Drawing Sheets

TRANSFER PRESS APPARATUS

CROSS-REFERENCE TO RELATED APPLICATIONS

"Not Applicable".

STATEMENT REGARDING FEDERALLY SPONSORED RESEARCH OR DEVELOPMENT

"Not Applicable".

BACKGROUND OF THE INVENTION

The present invention relates generally to a press apparatus for use in applying a heat transfer to a rigid or flexible substrate such as a plaque, tile, plate, article of clothing or the like, and more particularly, to a transfer press apparatus having an adjustment assembly for adjusting the pressure applied to a transfer during application to the substrate.

It is conventional to provide a transfer press apparatus having a fixed lower platen presenting a padded upper surface sized for receipt of an article of clothing and a heat transfer, and an upper platen provided with a heating element and being movable toward and away from the lower platen so that when the substrate and transfer are positioned on the lower platen and the upper platen is moved against the lower platen, the heat transfer is applied to the substrate.

The conventional construction also includes a support arm for supporting the upper platen for movement relative to the lower platen between the raised and lowered positions, and a linkage for carrying out the movement. The linkage not only is used to raise and lower the upper platen, but also applies a predetermined pressure to the upper platen against the lower platen in the lowered position to facilitate application of the transfer. A pressure adjustment assembly is supported between the upper platen and the support arm for adjusting the position of the upper platen relative to the support arm, and includes a threaded rod extending through the support arm and secured to the upper platen. A grip or handle is provided at the upper free end of the threaded rod, enabling the rod to be threaded into and out of the support arm to adjust the relative position of the upper platen. As such, it is possible to adjust the pressure exerted on the transfer and substrate by the upper platen.

Although the conventional construction allows the pressure between the platens to be adjusted, several technical problems are encountered. For example, because the threaded rod must be turned through several complete revolutions to move the upper platen through the complete range of adjustment, it is not possible, without counting turns of the handle, to gauge the extent of adjustment made to the upper platen's position. For the same reasons, once the rod is adjusted from a first setting to a subsequent one, it is difficult to return accurately and quickly to the first setting.

BRIEF SUMMARY OF THE INVENTION

It is an object of the present invention to solve the technical problems left unaddressed by the prior art, and to provide a transfer press apparatus that can be quickly and repeatedly adjusted between a plurality of pre-established pressure settings such that the press can be used to apply transfers to substrates having different thicknesses or to apply transfers having different pressure requirements.

In accordance with this and other objects evident from the following description of a preferred embodiment of the invention, a transfer press apparatus is provided which includes, among other features, a frame presenting a lower platen, at least one support arm mounted on the frame for movement between raised and lowered positions, and an upper platen suspended from the support arm for movement on the arm relative to the lower platen. The upper platen presents a mounting bracket by which the platen is suspended from the support arm, and the bracket and support arm both present apertures within which an eccentric pin is supported. A lever protrudes generally radially from the pin for permitting rotation of the pin to adjust the position of the upper platen relative to the support arm.

In accordance with another aspect of the invention, the pressure adjusting assembly includes a sector plate presenting an arcuate engagement surface extending along the path of movement of the lever. The engagement surface includes a plurality of detents that are spaced from one another along the surface and adapted to be engaged by the lever, and indicia are provided in association with the detents which are representative of the various pressure settings.

By providing a construction in accordance with the present invention, numerous advantages are realized. For example, by providing a transfer press in which the upper platen and support arm are connected together through an eccentric pin, the entire range of adjustment of the upper platen can be achieved by rotating the pin through a single half-revolution enabling a plurality of positions of the pin to be marked for use in repeatedly setting the platen to any desired setting. Further, by providing a sector plate having a detented engagement surface, it is possible to easily locate any particular setting for subsequent use.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figure 1:
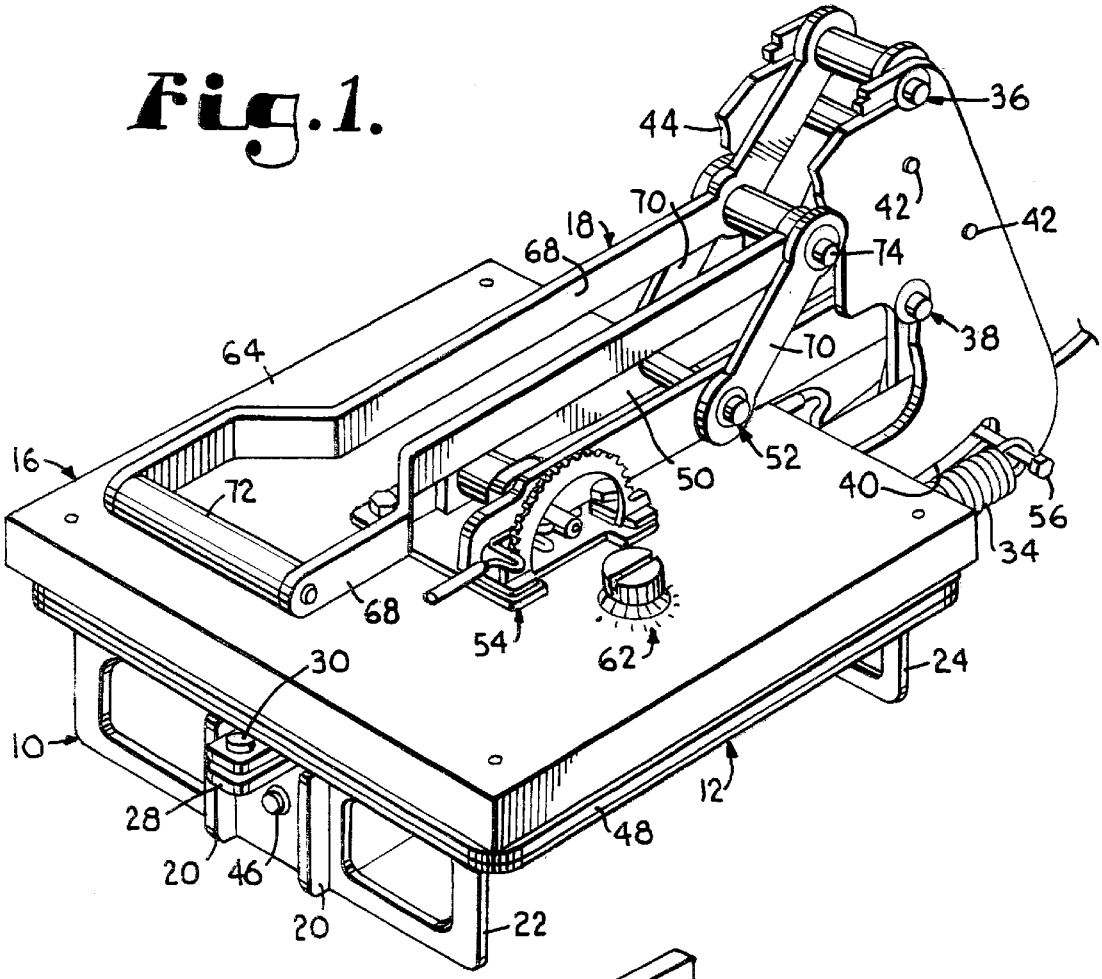
FIG. 1 is a perspective view of a transfer press apparatus constructed in accordance with the preferred embodiment of the present invention.

A transfer press apparatus constructed in accordance with the preferred embodiment of the present invention is illustrated in FIG. 1, and broadly includes a frame 10, a lower platen 12 secured to the frame, a support arm assembly 14 supported on the frame for pivotal movement between raised and lowered positions relative to the lower platen, and an upper platen assembly 16 suspended from the support arm assembly. In addition, a handle assembly 18 is connected between the frame and the arm assembly for shifting the arm assembly between the raised and lowered positions and for applying pressure to the upper platen during application of a heat transfer.

Figure 3:
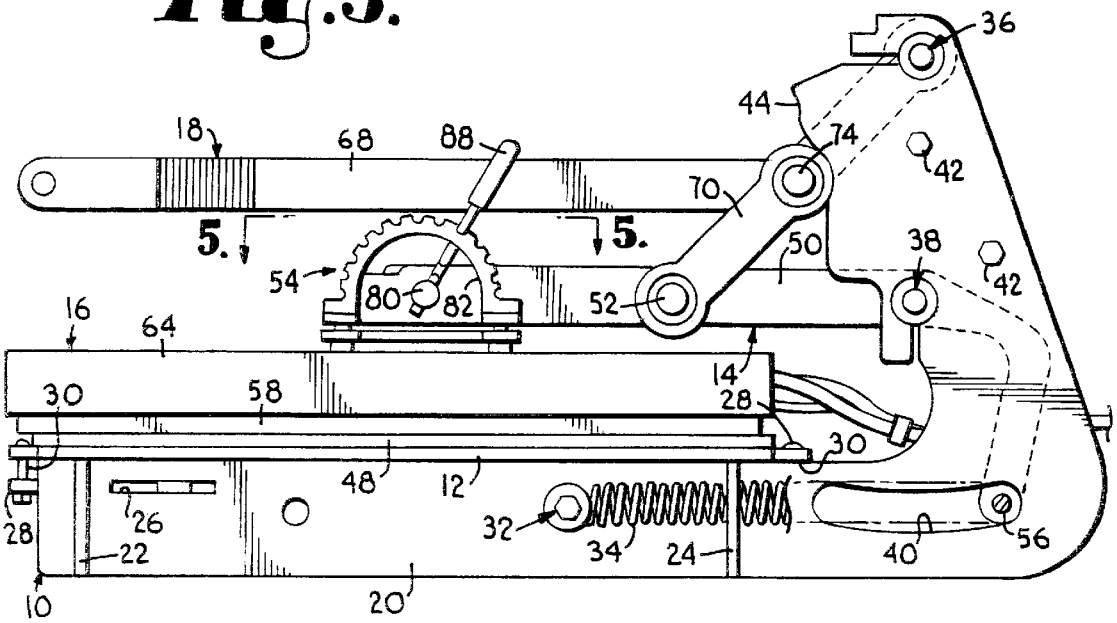
FIG. 3 is a side elevational view of the press apparatus, illustrating an upper platen thereof in a lowered position.

The frame is defined by a pair of side walls 20 that are spaced from one another and secured in place by two longitudinally opposed end walls 22, 24. All of the walls are preferably laser cut from steel plates, and are shaped for interengagement with one another in order to reduce the number of fasteners required to assemble the frame. As shown in FIG. 3, the side walls 20 are identical to one another, and each is generally L-shaped, including a lower horizontal base portion and an upstanding tower portion. The base portion includes a bottom edge adapted to engage a support surface and an opposing upper edge on which the lower platen is supported. A pair of longitudinally spaced slots are formed in the base portion and extend upward from the lower edge, defining the notches in which the front and rear end walls 22, 24 are received. The upper edge includes a pair oftabs that protrude slightly above the edge and engage the lower platen to position the platen on the frame. A transverse slot 26 is formed in each base portion immediately beneath each of the tabs for receiving a platen attachment plate 28. One of the attachment plates is received in each pair of slots, wherein the plate 28 in the front slots protrudes forward of the frame and the other plate is received in the rear pair of slots and protrudes toward the rear of the frame. Each attachment plate 28 is preferably laser cut from a steel plate, and includes a pair of laterally protruding tabs that are received in the slots 26, and a longitudinally extending tongue that protrudes through one of the end walls of the frame and presents a hole in which a conventional fastener 30 is received.

A transverse hole is formed in the base portion of each of the side walls, and a shaft 32 extends through and is secured in place within the holes. The shaft 32 protrudes laterally from each hole, presenting end portions that define seats to which a pair of tension springs 34 are secured.

The tower portion of each side wall 20 includes an upper end defining the top of the frame, and longitudinally opposed front and rear edges extending between the top edge and the base portion of the wall. An upper transverse hole is formed in each tower portion adjacent the top edge, and is adapted to receive a pivot pin 36 of the handle assembly, as described below. A lower transverse hole is provided in each tower portion directly beneath the upper hole, and is adapted to receive a pivot pin 38 of the support arm assembly 14. The axes of the two holes are disposed within a common vertical plane. Preferably, both holes are formed in the side walls by laser cutting, and slots connect the holes to an adjacent edge of the tower portion to facilitate formation thereof An arcuate slot 40 is formed in each side wall at the base of the tower portion, and defines a center of curvature collinear with the axis of the pin 38. Two additional transverse holes are provided in the tower portion of each side wall, and are adapted to support rods 42 on which spacers are provided for maintaining the spacing between the walls upon assembly of the frame.

The front edge of the tower portion of each side wall is shaped to define an engagement or abutment surface 44, which limits travel of the support arm assembly.

Returning to FIG. 1, the end walls 22, 24 are substantially similar to one another in that each is generally rectangular in front elevational shape, including a bottom edge adapted to engage a support surface and an opposing upper edge on which the lower platen is supported. A pair of longitudinally spaced slots are formed in each wall and extend downward from the upper edge, defining the notches in which the side walls are received. The upper edge also includes a pair of tabs that protrude slightly above the edge and engage the lower platen to position the platen on the frame. A transverse slot is formed in each end wall between the slots for receiving the tongue of one of the platen attachment plates 28, as described previously. A small aperture is formed in the front end wall intermediate the slots, and is adapted to support an indicator light 46 forming a part of the apparatus.

Figure 4:
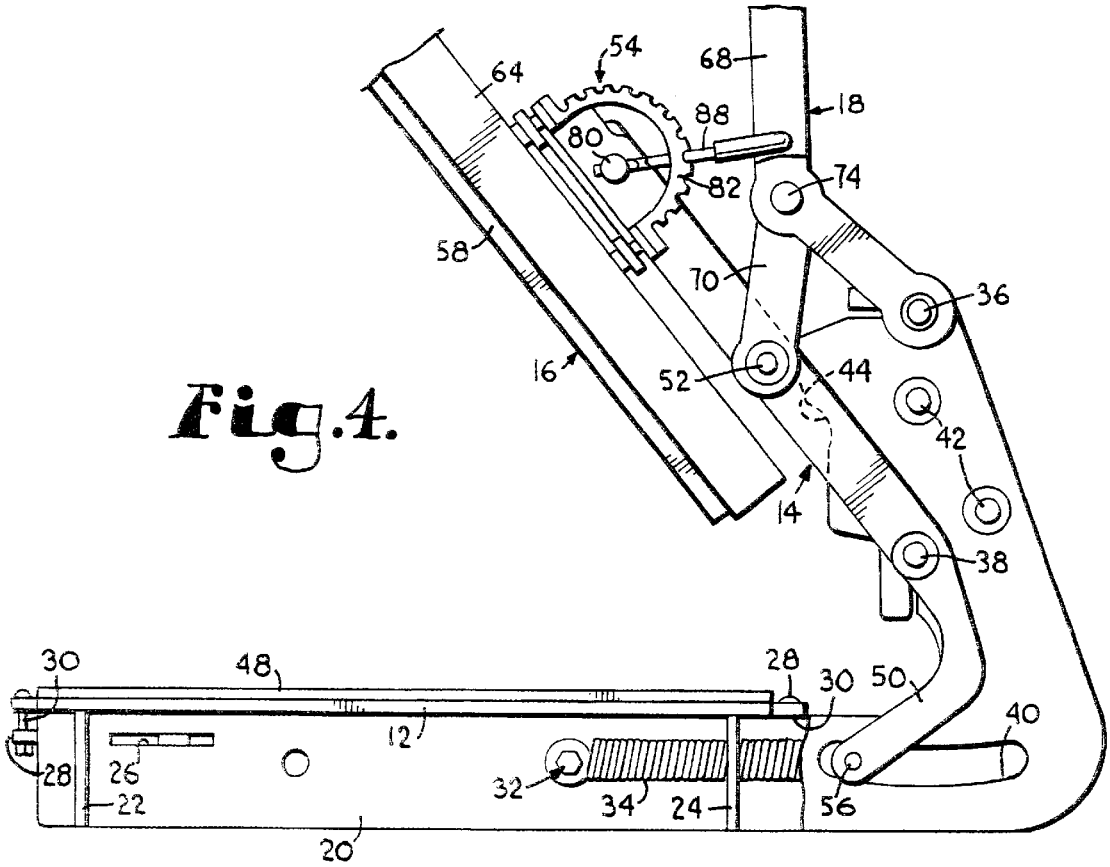
FIG. 4 is a fragmentary side elevational view of the press apparatus, illustrating an upper platen thereof in a raised position.

The lower platen 12 is generally square in plan shape and presents a planer upper surface, although platens of various sizes and shapes can be used in the apparatus. The illustrated platen is preferably laser cut from a plate of steel, and includes front and rear projections defining holes through which the fasteners 30 are received such that the platen can be secured to the attachment plates 28 of the frame. Longitudinally extending slots are formed in the platen which are positioned to engage the tabs of the side walls, and laterally extending slots are formed adjacent the front and rear edges of the platen for engagement with the tabs presented by the end walls. As shown in FIG. 4, a pad 48 of silicon or other compressible material is adhered or otherwise supported on the upper surface of the lower platen for distributing pressure evenly across a substrate during application of a heat transfer.

The support arm assembly 14 is shown in FIG. 1, and includes a pair of laterally spaced, longitudinally extending support arms 50 that are preferably laser cut from steel plates, wherein each arm includes a generally horizontally extending front section and a depending, generally vertical rear section. A transverse hole is formed in each arm adjacent the rear of the front section for receiving the pivot pin 38 by which the arms are supported in the lower aperture of the frame for pivotal movement between an upper position in which the front sections of the arms are raised away from the lower platen, as shown in FIG. 4, and a lowered position, shown in FIG. 3, in which the front sections of the arms are lowered into a position adjacent the lower platen. Two additional holes are provided in the front section of each arms forward of the hole. The rear hole is sized for receipt of a pivot pin 52 by which the arms are connected to the handle assembly 18, and the forward hole is sized for receipt of a pressure adjustment assembly 54, as described below.

As shown in FIG. 4, the rear section of each mounting arm includes a lower end in which a hole is formed for receipt of a pin 56. The pin protrudes beyond the holes in the arms into the slots 40 of the side walls 20, and defines a seat by which the two springs are supported. The springs 34 exert a tension on the lower ends of the arms 50 with sufficient force to lift the arms to the raised position and support them there.

Figure 8:
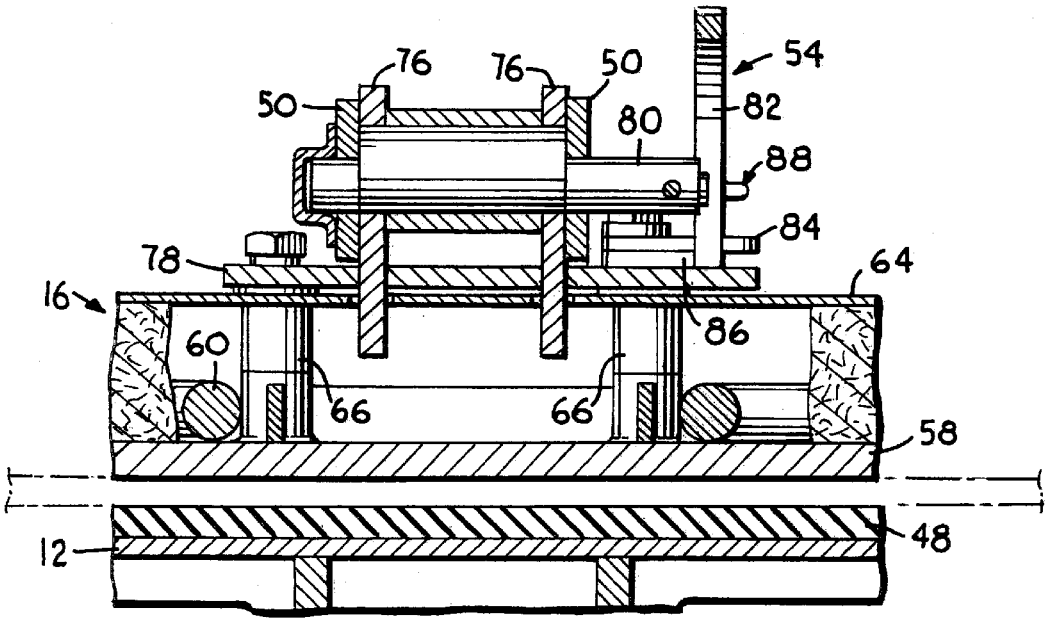
FIG. 8 is a fragmentary sectional view taken along line 8—8 of FIG. 6.

As illustrated in FIG. 1, the upper platen assembly 16 broadly includes an upper platen 58, a heating element 60, shown in FIG. 8, for heating the upper platen to an elevated temperature, a thermostat 62 for controlling the operation and temperature of the heating element, and a cover or heat shield 64 enclosing the heating element and thermostat. The upper platen 58 generally corresponds in size and shape to the lower platen, and preferably includes a planer bottom surface facing the lower platen so that when the platens are brought together during application of a transfer, the transfer is heated and pressed against the substrate.

Referring to FIG. 8, the upper surface of the platen 58 is sized for receipt of the heating element 60. The heating element can be of any desired shape that provides substantially uniform heating of the platen without creating hot spots. Four upstanding posts 66 are provided on the top of the platen, and each includes an axially extending threaded bore sized for receipt of a fastener of the pressure adjustment assembly 54, as described below. Gussets extend between the posts and radially outward therefrom to strengthen the posts and the platen.

The thermostat 62, as shown in FIG. 1, is conventional, including a manually actuated knob for turning the heating element on and off, and for controlling the temperature of the heating element. The knob protrudes above the heat shield 64, and indicia are provided on the surface of the shield around the knob for indicating the positions of the knob. The indicator light 46 forms a part of the thermostat, and is mounted in the hole in the front end wall of the frame within easy view of a user. The light 46 is activated when the thermostat is turned to any "on" position, and remains lit until the heating element has reached the preset temperature. Thereafter, the light goes out, indicating that the apparatus is ready for use.

The cover or shield 64 is constructed from sheet metal or the like, and includes a top wall and a perimeter side wall. The top wall include holes for the knob of the thermostat 62 and for various components of the pressure adjustment assembly. Otherwise, the cover is closed to protect users from direct exposure to the heating elements and the wiring to the thermostat.

The handle assembly 18 includes a pair of laterally spaced, longitudinally extending levers 68 and a pair of links 70, all of which are preferably laser cut from steel plates. Each lever 68 includes a generally horizontally extending front section and an upwardly angled rear section. A transverse hole is formed in each lever at the front end thereof and a handle or grip 72 is secured in place between the levers by fasteners extending through the holes. A second transverse hole is formed in each lever at the rear end of the rear section for receiving the pivot pin 36 by which the levers are supported in the upper aperture of the frame for pivotal movement between raised and lowered positions. A third transverse hole is formed in each lever at the point of intersection of the front and rear sections, and is sized for receipt of a pivot pin 74 by which the links 70 are supported on the lever for pivotal movement. The links 70 are supported between the pin 74 on the levers and the pin 52 on the support arms, and transfers movement of the levers to the support arms, shifting the support arms between the upper and lower positions.

Figure 5:
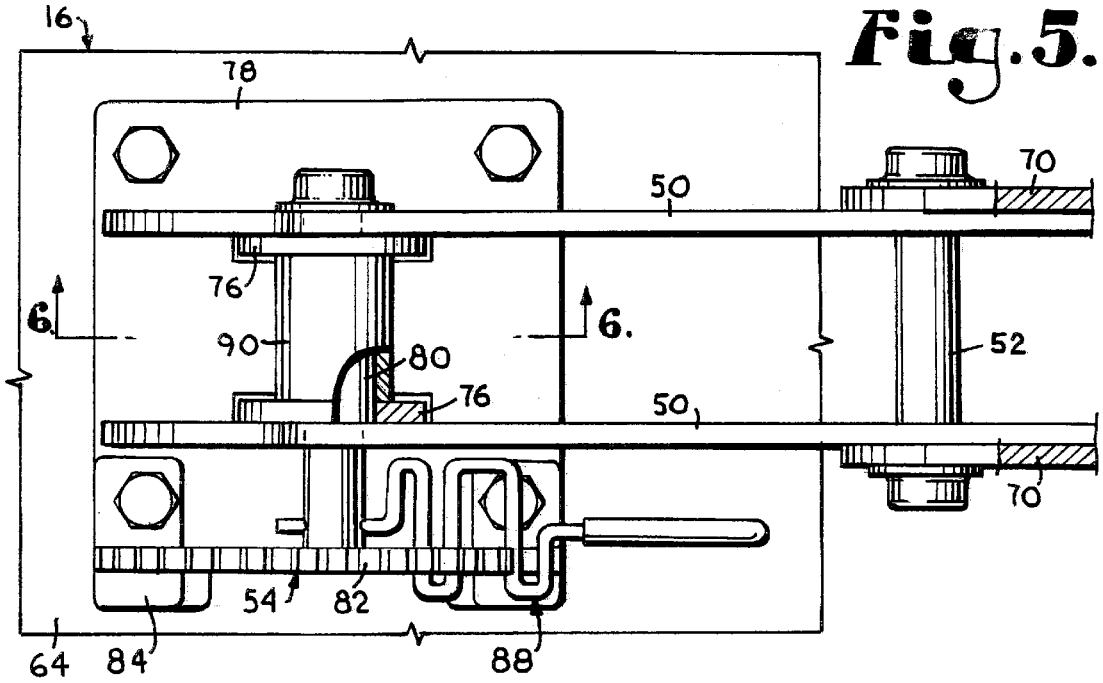
FIG. 5 is a fragmentary sectional view of the apparatus taken along line 5—5 of FIG. 3, illustrating the pressure adjustment assembly.

With reference to FIGS. 3 and 4, the pivot pin 36 of the levers and the pivot pin 52 between the links 70 and the support arms 50 define longitudinal axes that are disposed in a common plane, and the pivot axis defined by the pin 74 supporting the links on the levers defines another longitudinal axis, wherein the axis of the pin 74 is displaced slightly below the plane in the lowered position of the support arms, shown in FIG. 5, and is displaced above the plane in the raised position of the support arms, shown in FIG. 4. As such, the linkage of the handle assembly 18 defines an over-center or over-toggle arrangement that allows the springs 34 to bias the upper platen 58 toward the raised and lowered positions depending on whether the axis of the pin 74 is disposed above or below the plane defined by the pins 36, 52. The limit positions of the support arms 50 are defined by the stop surface 44 of the frame tower which are engaged by the links 70 to prevent further movement in either direction.

The pressure adjustment assembly 54 is supported between the upper platen 58 and the support arms 50 for adjusting the position of the upper platen relative to the support arms. By adjusting this positional relationship, the pressure exerted on the transfer and substrate during an application operation is adjusted.

Figure 2:
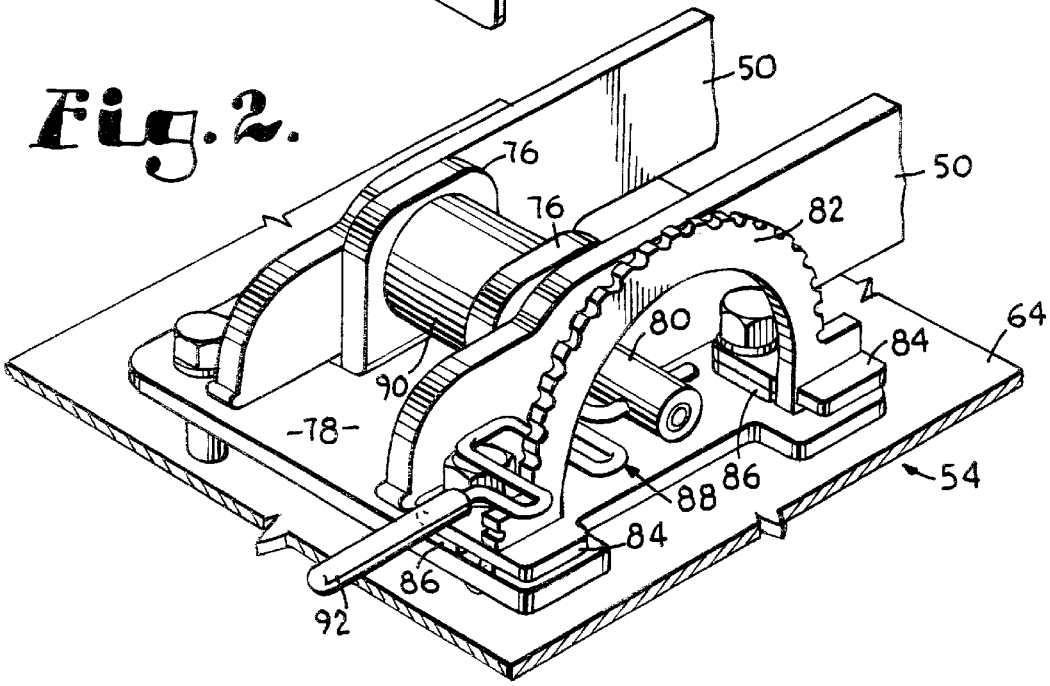
FIG. 2 is a fragmentary perspective view of a pressure adjustment assembly forming a part of the press apparatus.
Figure 6:
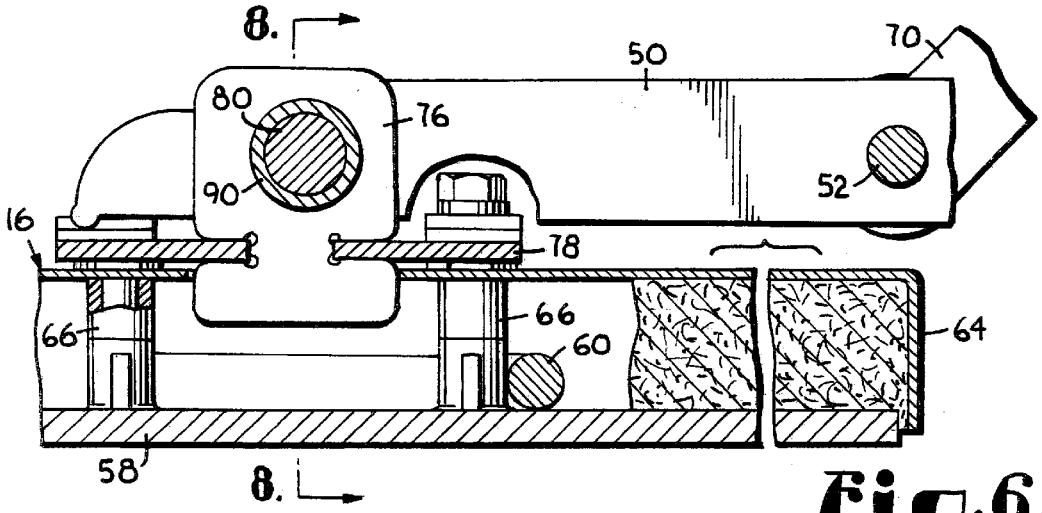
FIG. 6 is a fragmentary sectional view taken along line 6—6 of FIG. 5.

As shown in FIG. 2, the assembly 54 includes a pair of mounting brackets 76 supported on the upper platen by a mounting plate 78, and an eccentric pin 80 supported between the brackets 76 and the support arms 50 such that rotation of the pin adjusts the position of the upper platen relative to the support arm. The mounting brackets 76 are identical to one another and are preferably laser cut from steel plates. As shown in FIG. 6, each bracket includes a rounded upper end in which a transverse hole is formed for receipt of the pin 80, and a bottom end in which a pair of laterally spaced notches are formed.

Figure 9:
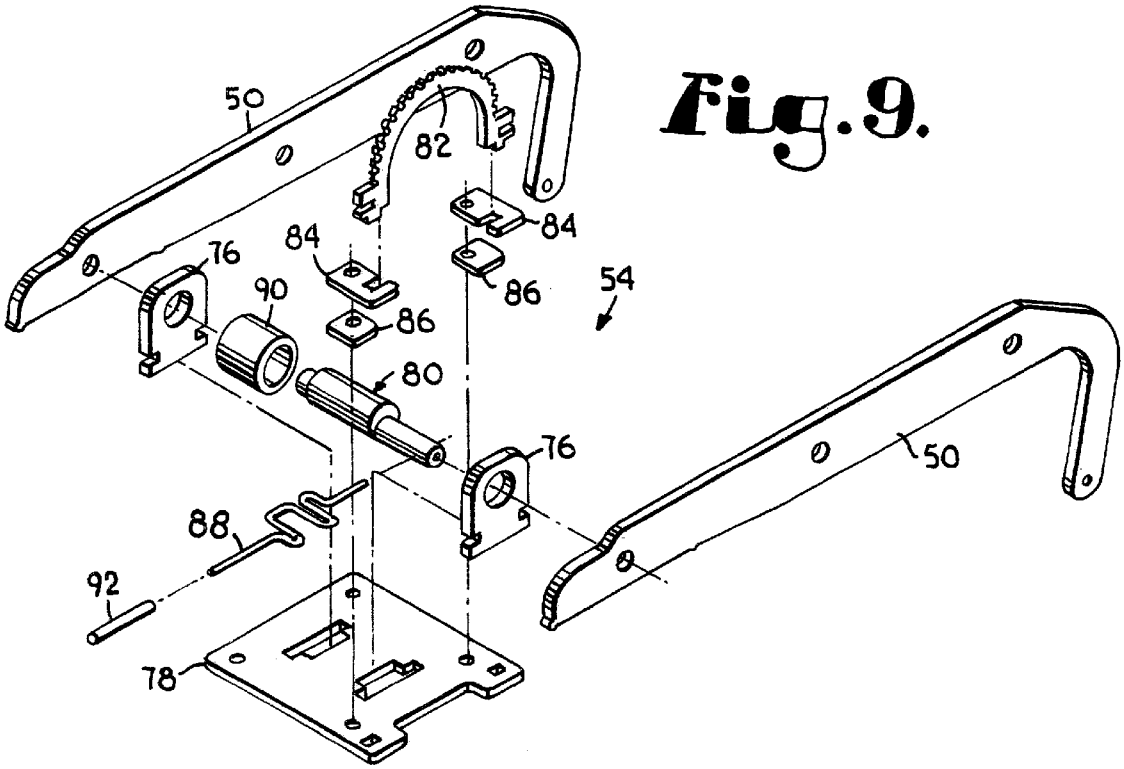
FIG. 9 is an exploded view of the pressure adjustments assembly and a pair of support arms forming a part of the apparatus.

As shown in FIG. 9, the mounting plate 78 is also preferably laser cut from a steel plate, and includes a pair of central cutouts sized for receipt of the brackets 76. Each cutout includes a laterally outer region through which one of the brackets can be inserted into the cutout, and a laterally inner region having a width smaller than the outer region and sized to engage the notches in the bracket. The mounting plate also includes four holes located to align with the holes in the posts of the upper platen, and a pair of apertures adapted to receive a sector plate 82 forming a part of the assembly.

Figure 7:
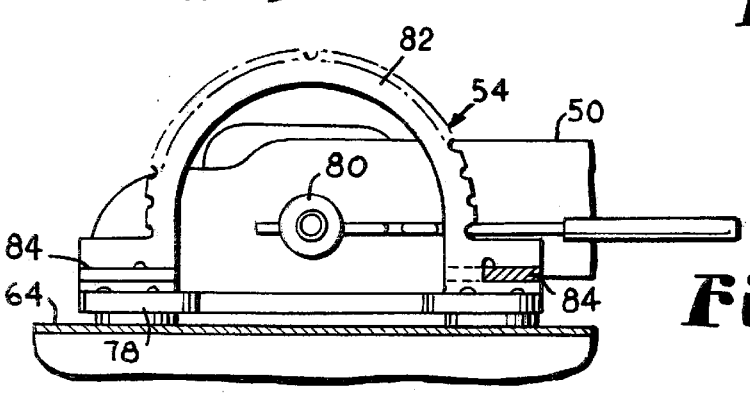
FIG. 7 is a fragmentary side elevational view of the pressure adjustment assembly.

As shown in FIG. 7, the sector plate 82 is C-shaped, including a pair of ends and an arcuate central region. The ends each include a downwardly directed tab sized for receipt in one of the apertures of the mounting plate to position the sector plate. A notch is also formed in each end of the sector plate above the tabs. The central region of the sector plate presents an upper engagement surface that includes a plurality of semi-circular notches, and indicia are provided adjacent at least some of the notches to distinguish them from the remaining notches.

Returning to FIG. 9, the sector plate 82 is secured to the mounting plate by a pair of clamp plates 84. Each clamp plate includes a hole for receipt of one of the fasteners, and a notch sized to engage the notch in one of the ends of the sector plate. Shims 86 are positioned between the mounting plate and the clamp plates to align the clamp plates with the notches in the sector plate.

The pin 80 includes a central region defining a first longitudinal axis and a pair of axially opposed collinear end regions defining a second longitudinal axis that is parallel to and offset from the first longitudinal axis. The central region of the pin is received in the holes of the mounting brackets 76 and is supported for rotation therein, and the outer end regions are received in the holes of the support arms 50 and are supported for rotation therein. As shown in FIG. 5, a tubular sleeve 90 is supported on the central region of the pin 80 between the brackets 76, and spaces the brackets from one another. With reference to FIG. 2, a radial hole is formed in one end region of the pin, and an axial threaded bore extends into the end of the pin into communication with the radial hole.

A lever 88 is supported in the radial hole of the pin 80 and is retained in place by a set screw received in the axial bore. The lever 88 is formed of spring wire or the like, and permits rotation of the pin to adjust the position of the upper platen relative to the support arm. Preferably, the lever includes a first section received in the radial hole of the pin, a second or distal free end on which a grip or cap 92 is received, and a middle portion that is bent back and forth several times to present upper and lower guide portions that guide movement of the lever relative to the sector plate 82. As shown in FIG. 7, the lower guide portion is spaced slightly from the sector plate, and the upper guide portion engages the engagement surface of the plate such that the lever engages the notches when the lever is released. In order to adjust the position of the lever 88, and thus of the pin 80, the distal end of the lever is gripped and pushed laterally inward along the axis of the pin 80, lifting the upper guide portion of the lever out of engagement with the upper surface of the sector plate 82 and allowing movement of the lever and pin.

With reference to FIG. 1, in order to apply a heat transfer to a flexible substrate, e.g. a t-shirt, the position of the upper platen 58 is first adjusted so that a proper pressure will be applied when the platen is lowered against the lower platen 12. In order to make this adjustment, the lever 88 is gripped and moved laterally out of contact with the sector plate 82, and is shifted to rotate the eccentric pin until a desired setting is reached. Thereafter, the lever is released, and engages one of the notches in the sector plate to retain the setting.

With the pressure set, the thermostat 62 is actuated to set the temperature of the platen 58, and the substrate and transfer are positioned on the lower platen 12. Once the desired temperature is reached, the indicator light 46 goes out, and the operator grips the handle 72 and lowers the platen against the lower platen. The linkage of the handle assembly 18 forces the support arms 50 to the lowered position, exerting the preset pressure against the upper platen. If the platen 58 is adjusted to a position relatively high on the support arms, a relatively low pressure is exerted on the transfer. If the position of the upper platen on the arms is relatively low, a greater pressure is exerted. The compressed forced stored in the pad 48 retains the support arms in the lowered position during application of the transfer, due to the over-center design of the handle assembly, and the handle 72 is lifted after a predetermined time has lapsed to allow removal of the transfer and substrate.

If, subsequent to application of a transfer to a t-shirt, it is desired to apply a transfer to a substrate having a different thickness, such as to a sweatshirt, the lever 88 of the pressure adjustment assembly 54 is again manipulated to rotate the pin 80 to a position in which upper platen is raised slightly to accommodate for the thickness of the substrate. If it is desired to return to the setting employed with the original t-shirt transfer, it is only necessary to move the lever of the adjustment assembly back to the notch in which it was originally located. It is not necessary to count the revolutions of a threaded rod or to guess at the original location, as in conventional constructions.

Although the invention has been described with reference to the preferred embodiment illustrated in the attached drawing figures, it is noted that substitutions may be made and equivalents employed herein without departing from the scope of the invention as recited in the claims.

I claim:

1. A transfer press apparatus comprising:

a frame presenting a lower platen;

at least one support arm mounted on the frame for movement between a raised position remote from the lower platen, and a lowered position adjacent to the lower platen, the arm presenting a first aperture;

an upper platen suspended from the at least one support arm for movement relative to the lower platen, the upper platen presenting at least one mounting bracket by which the upper platen is connected to the support arm, the mounting bracket defining a second aperture; and a pressure adjustment assembly supported between the upper platen and the at least one support arm for adjusting the position of the upper platen relative to the support arm, the pressure adjustment assembly including a pin supported in the first and second apertures and including at least one first region defining a first longitudinal axis and at least one second region defining a second longitudinal axis that is parallel to and offset from the first longitudinal axis, the first and second regions of the pin being supported in different ones of the first and second apertures such that rotation of the pin in the apertures adjusts the position of the upper platen relative to the support arm, and a lever protruding generally radially from the pin for permitting rotation of the pin to adjust the position of the upper platen relative to the support arm.

2. The apparatus as recited in claim 1, wherein a pair of support arms are provided, each presenting a first aperture that is collinear with the other first aperture.

3. The apparatus as recited in claim 1, wherein the upper platen presents a pair of mounting brackets, each defining a second aperture that is collinear with the other second aperture.

4. The apparatus as recited in claim 1, wherein the pressure adjusting assembly includes a sector plate including an arcuate engagement surface extending along the path of movement of the lever, the engagement surface presenting a plurality of detents that are spaced from one another along the surface and adapted to be engaged by the lever.

5. The apparatus as recited in claim 4, wherein the pressure adjusting assembly includes indicia associated with the detents, the indicia being representative of the position of the upper platen relative to the support arm when the lever engages the associated detent.

6. The apparatus as recited in claim 1, further comprising a handle assembly for shifting the at least one support arm between the raised and lowered positions, the handle assembly including at least one lever arm supported on the frame for pivotal movement about a pivot axis, and at least one link connected between the lever arm and the at least one support arm for transmitting pivotal movement of the lever to the support arm.

7. The apparatus as recited in claim 6, wherein the at least one link defines a first pivot axis at which the link is connected to the lever and a second pivot axis at which the link is connected to the at least one support arm, the first pivot axis being located beneath a plane intersecting the pivot axis of the lever and the second pivot axis of the link so that the first pivot axis of the link moves across the plane when the lever is pivoted from the raised position to the lowered position.

8. The apparatus as recited in claim 7, wherein the frame presents a stop surface against which the handle assembly bears in the lowered position of the lever, limiting further pivotal movement of the lever.

9. The apparatus as recited in claim 1, wherein the upper platen is suspended from the at least one support arm by the pin of the pressure adjustment assembly for unrestricted pivotal movement on the pin during movement of the arm between the raised and lowered positions.

* * * * *